US005447213A

United States Patent [19]

Habicht

[11] Patent Number: 5,447,213

[45] Date of Patent: Sep. 5, 1995

[54] REINFORCED COLUMN FOR A LIFTING APPARATUS

[76] Inventor: Helmut Habicht, 15 Royal Park Ter., Hillsdale, N.J. 07642

[21] Appl. No.: 252,901

[22] Filed: Jun. 2, 1994

[51] Int. Cl.[6] ..... B66B 7/02

[52] U.S. Cl. ..... 187/406; 187/238; 187/363; 187/410

[58] Field of Search ..... 187/406, 408, 409, 410, 187/363, 228, 230, 238; 414/419, 420, 422, 630, 631

[56] References Cited

U.S. PATENT DOCUMENTS

| | | | |
|---|---|---|---|
| 1,024,300 | 4/1912 | Tözsér | 187/363 |
| 1,986,620 | 1/1935 | Borden et al. | 187/406 X |
| 2,915,210 | 12/1959 | Ehmann | 187/230 X |
| 4,222,461 | 9/1980 | Gunti | 187/406 X |
| 5,318,154 | 6/1994 | Hellman, Jr. et al. | 187/406 X |

*Primary Examiner*—William E. Terrell
*Assistant Examiner*—Dean A. Reichard
*Attorney, Agent, or Firm*—Patrick J. Pinto

[57] ABSTRACT

A reinforced column for a lifting apparatus which includes an elongated outer shell member having a rectilinear cross-section. One side of the outer shell member has an elongated aperture therethrough, allowing access to an interior portion of the column. Interior of the outer shell, a pair of opposed elongated guide rails are positioned adjacent the elongated aperture. An elongated inner shell is simultaneously attached to selected portions of the guide rails and held at predetermined spaced relationships to the interior surfaces of the outer shell. The elongated inner shell is arrayed for providing a pathway for a carriage member of said lifting apparatus to travel therein.

6 Claims, 2 Drawing Sheets

REINFORCED COLUMN FOR A LIFTING APPARATUS

BACKGROUND OF THE INVENTION

1. Field of the Invention

With regard to the classification of art, this invention is believed to be found in the general class entitled "Material or Article Handling" and more particularly to those subclasses pertaining to column structures.

2. Description of Related Art

Columns for apparatus which are used for lifting of containers, drums and the like have been shown in U.S. Pat. No. 5,205,699 issued to me on Apr. 27, 1993; U.S. Pat. No. 4,954,037, issued to me on Sep. 4, 1990, and U.S. Pat. No. 4,797,050 issued to me on Jan. 10, 1989. Each of these lifting apparatus are designed for relatively short movement of the container.

The known prior art described above are limited to the distance of vertical travel of a container as well as the load bearing capacity of the column. It has been determined that there is a need for a lifting apparatus which has a small envelope column member. This desired column member must be capable of lifting a heavy load for an uninterrupted distance in the vicinity of 40 feet. It is also desired that the column have the ability to be used in a clean room environment.

The present invention improves the strength of a column member of a lifting apparatus while maintaining a small exterior envelope. The column of the present invention also allows a carriage member to be guided interior of the column member.

SUMMARY OF THE INVENTION

This invention may be summarized in part with respect to its objects. It is an object of this invention to provide and it does provide a column for a lifting apparatus which is reinforced while providing a smooth outer shell.

It is another object of this invention to provide and it does provide a column for a lifting apparatus which includes a reinforcing means which allows a continuous pathway for a carriage member traveling interior of the column member.

It is yet another object of this invention to provide and it does provide a column member for a lifting apparatus which includes a reinforcing means which allows a pathway for control conduits and the like.

It is still another object of this invention to provide and it does provide a column member for a lifting apparatus including a reinforcing means which has a portion of a safety means integrally formed therein.

In summary, one aspect of a reinforced column for a lifting apparatus includes: an elongated outer shell member, having a rectilinear cross-section, one side of the outer shell having an elongated aperture therethrough. The elongated aperture having a predetermined length for allowing access to an interior portion of said column. The column further includes a pair of elongated guide rails, each of the elongated guide rails being positioned interior of the column and adjacent to the elongated aperture, such that a major axis of the elongated guide rails is in substantially parallel alignment with a major axis of said elongated aperture. A reinforcing means being simultaneously attached to selected surfaces of each elongated guide rail and selected interior surfaces of said outer shell, said reinforcing means having a predetermined profile for allowing a carriage member of said lifting apparatus to travel interior of said column while being guided by said elongated guide rails.

In addition to the above summary, the following disclosure is detailed to insure adequacy and aid in the understanding of the invention. However this disclosure, while showing various embodiments of the present invention is not intended to describe each new inventive concept which may arise. There have been chosen specific embodiments which are believed to show at least one best mode for a reinforced column for a lifting apparatus. The specific embodiments have been chosen for the purpose of illustration and description as shown in the accompanying drawings:

Figure 4:
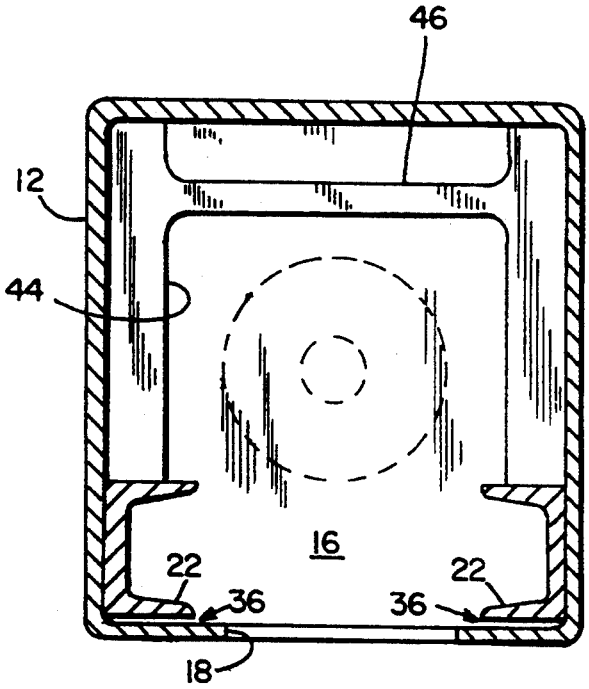
FIG. 4 represents a plan view, in section and partly diagrammatic, of a third embodiment of a reinforced column member of the present invention.

In the following description and in the claims, various details are identified by specific names for convenience. These names are intended to be generic in their application while differentiating between the various details. Corresponding reference numbers refer to like members throughout the several figures of the drawing.

The drawing accompanying and forming a part of this specification discloses details of construction for the sole purpose of explanation. It is to be understood that structural details may be modified without departing from the concept and principles of the invention as claimed. This invention may be incorporated in other structural forms than shown.

DETAILED DESCRIPTION OF THE INVENTION

The present invention is a support column portion of a lifting apparatus for lifting and discharging of containers, drums and the like. Several types of lifting apparatus and their uses have been described in my patents listed above. The present invention is particularly used in a lifting apparatus which mounts a conventional hoist interior of a column.

Figure 1:
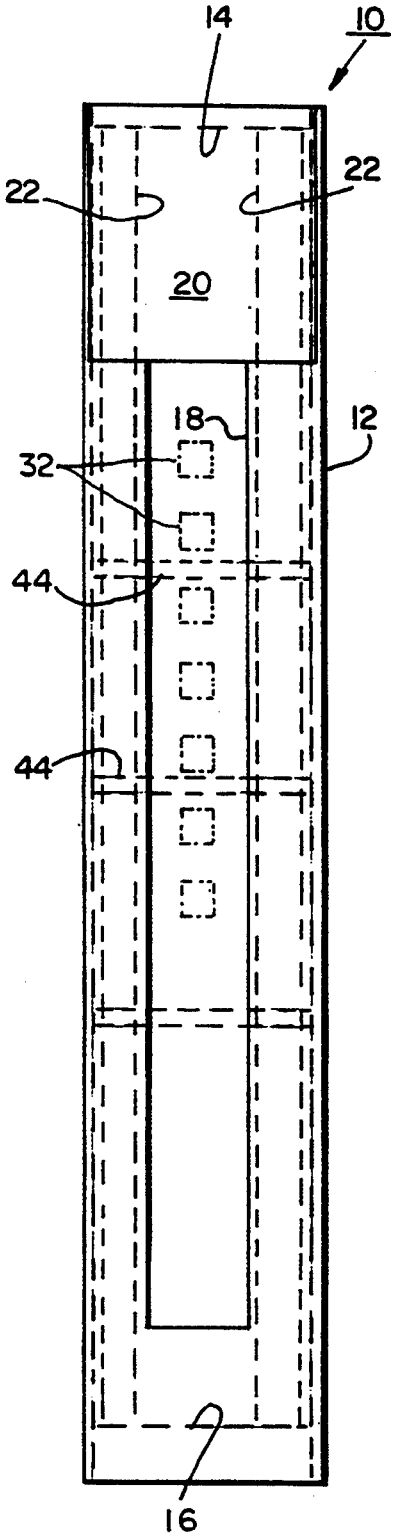
FIG. 1 represents a front elevational view of a reinforced column member of the present invention.

Referring now to FIG. 1, a reinforced column of the present invention is generally identified as 10. This reinforced column 10 includes an elongated outer shell 12 having a substantially rectilinear cross-section. The reinforced column member preferably has an upper end cap 14 and a lower end cap 16. The upper end cap 14 is usually configured for the attachment of a conventional hoist thereto. The hoist is not shown for clarity of the drawing. Typically an air operated chain hoist would be attached for heavy loads. Of course other types of hoist, such as a wire rope hoist, may be used for lighter loading requirements.

This reinforced column 10 further includes an elongated aperture 18, which is formed through one of the sides of the outer shell 12. A bridge plate 20 is attached to the upper end of the column. This bridge plate 20 provides one of the termination points for the aperture 18.

Figure 2:
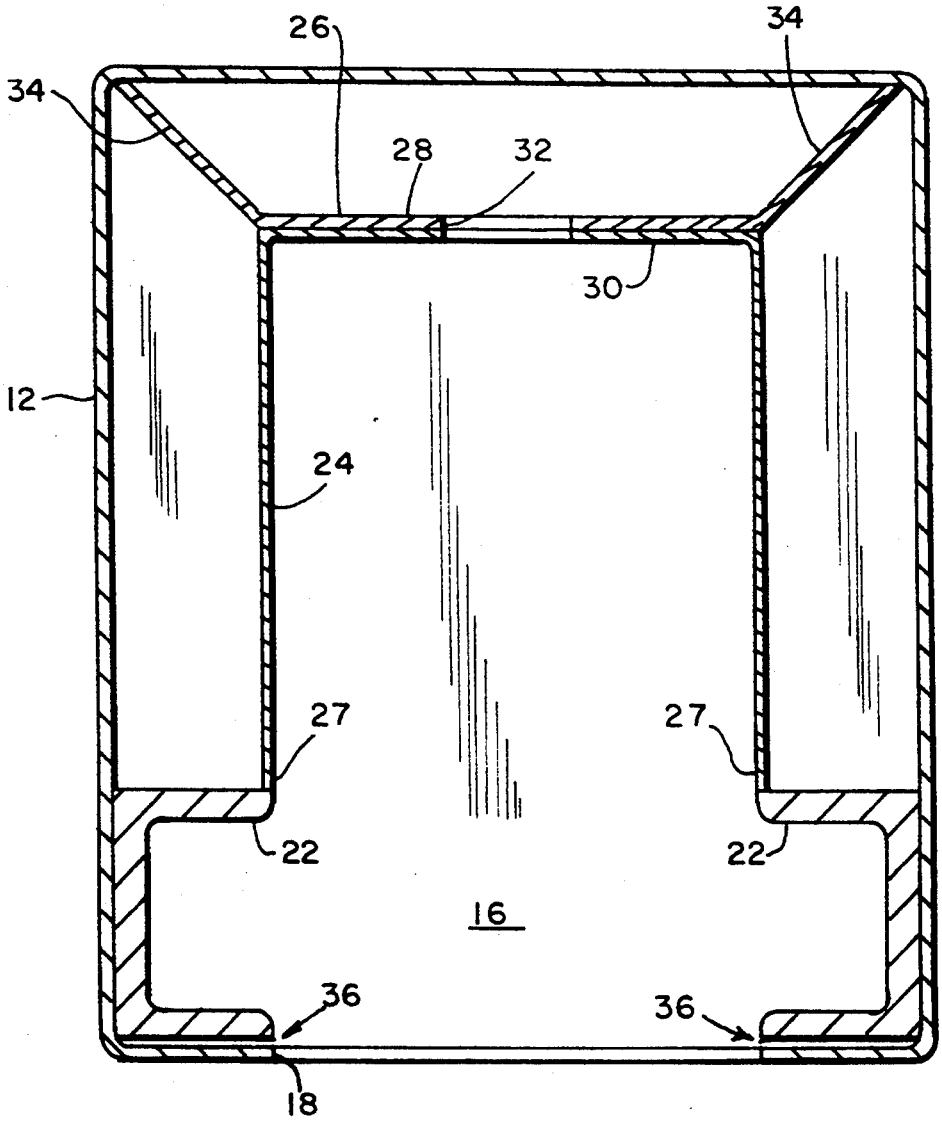
FIG. 2 represents a plan view, in section and partly diagrammatic, of a first embodiment of a reinforced column member of the present invention.

Referring now to FIGS. 2; 3; and 4, The elongated aperture 18 provides access to an interior portion of the reinforced column 10. The interior portion of the column 10 provides an uninterrupted pathway for a carriage member, which is not shown. The carriage member is typically lifted and lowered by the hoist. The elongated aperture 18 allows the carriage member to be attached to a container support. The container not shown, is genearlly mounted exterior of the column 10. Of course-other types of lifting and lowering means may be used. Some examples of carriage members are disclosed in my patents cited as prior art. The carriage member is guided, along its path of movement, by a pair of elongated guide rails 22. Examples of a guidance means for a carriage member are shown and described in my prior art patents noted above. Each of the elongated guide rails 22 has a U-shaped configuration. Each guide rail 22 is preferably positioned adjacent the elongated aperture 18. The positioning of the guide rails 22 is such that their major axis is in substantially parallel alignment with the major axis of the elongated aperture 18.

FIG. 2 illustrates a preferred embodiment of a reinforcing means for the column 10. This embodiment may be characterized as a double wall column member. This double wall column arrangement has been found to withstand heavy column loading. The preferred reinforcement includes an inner shell 24 and an attachment means 26. The inner shell 24 is formed in a substantially U-shape. End portions 27 of the inner shell 24 are attached to the elongated guide rails 22 by a suitable means such as welding. The inner shell 24 is positioned interior of the outer shell 12 for providing a predetermined spacing between the inner shell 24 and the outer shell 12. The attachment means 26 is preferably formed in a substantially trough or channel shape. The base portion 28 of the attachment means 26 abuts a web portion 30 of the inner shell 24, forming a multi-layered partition. A plurality of through apertures 32 are formed in the multi-layered partition. These apertures 32 are preferably formed at spaced intervals along a vertical line which is parallel to the major axis of the elongated aperture 18. The apertures 32 are sized and shaped to receive a pawl member, not shown, being carried by the carriage member. The multi-layered partition provides greater bearing surface during engagement of the pawl.

The embodiment illustrated in FIG. 2 provides a small envelope column having a smooth surface. This type of finish is very important when a lifting apparatus is installed in a clean room atmosphere. One example of a small envelope column includes an exterior envelope of 30 cm.×38 cm.(11.8 in.×15 in.). In this example, the walls of the inner shell 24 are spaced from the interior walls of the outer shell in the vicinity of 5.7 cm.(2.25 in.). It is important to note that the inner shell 24 must be firmly attached to the outer shell 12 and the guide rails 22. The attaching means 26 includes tie members 34 which connect the corners of the inner shell 24 with the interior corners of the outer shell 12. It is also important to note that the inner shell 24 should extend for at least the full length of the elongated aperture 18. It has been found that this configuration allows column lengths in the vicinity of 13.7 m.(45 ft.) for a 30 cm.×38 cm. column.

A track 36 may be formed between the guide rail 22 and the inner surface of aperture side of the outer shell 12. This track 36 allows a movable curtain, not illustrated, to be guided therin when required.

Figure 3:
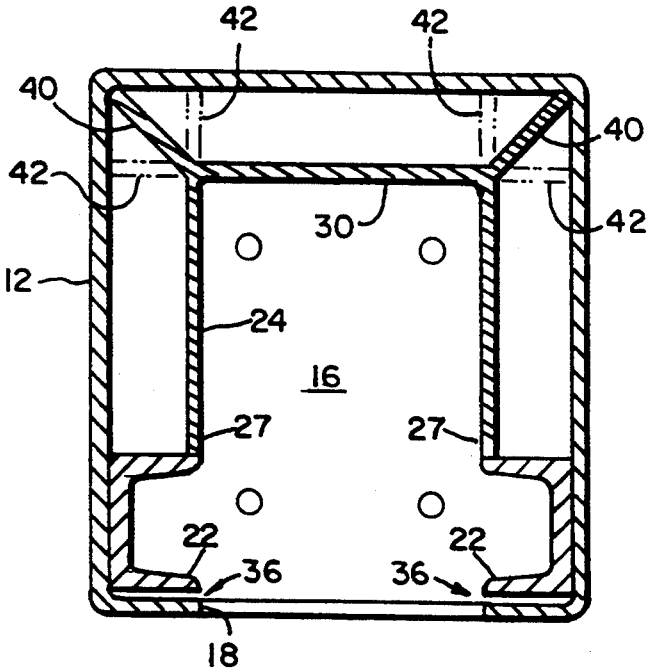
FIG. 3 represents a plan view, in section and partly diagrammatic, of a second embodiment of a reinforced column member of the present invention.

A second embodiment of a reinforced column is illustrated in FIG. 3. The construction of this column is similar to the double wall arrangement shown in FIG. 2. The major difference is that the partition formed by the web portion 30 of the inner shell 24 has only a single thickness. The attachment means 40 is preferably arrayed so that the corner of the inner shell 24 is connected to its associated interior corner of the outer shell 12. Apertures 32, shown in connection with FIG. 2 may be provided in the wall 30 as needed for a safety device. The optional apertures 32 are also shown in phantom outline in FIG. 1.

An alternate arrangement for the attachment means 40 may include a plurality of leg members 42, shown in dashed outline.

The spaces formed between the inner shell 24 and the outer shell 12 may be used as conduits for control power, such as electric, pneumatic, or hydraulic lines.

A third embodiment is illustrated in FIG. 4. This reinforcing arrangement eliminates the inner shell in favor of a plurality of substantially U-shaped rib members 44. It has been found that rib members 44 spaced at intervals of 47.7 cm. (18 in.) provide the desired reinforcing characteristics. The location of the rib members 44 is also shown in dashed outline in FIG. 1. The rib members 44 must be firmly attached to the interior surface of the outer shell 12 to provide the desired results. The rib members 44 may have a notched portion 46 formed therein to allow passage of power and control lines. It is anticipated that an inner shell similar to 24 may be attached to the rib members to provide a smooth interior surface when needed.

The upper end cap 14 and the lower end cap 16 may be configured as shown in FIG. 4, for attaching directly to a ceiling and floor of a structure. Alternatively the upper end cap 14 and the lower end cap 16 may be configured as shown in FIG. 4 with bearings for allowing pivotal movement of the column about a longitudinal axis passing through its center.

Some installations of a lifting apparatus utilizing the reinforced column of the present invention may require that the elongated aperture 18 be closed to the environment. A flexible curtain may guided in the track 36. This track may be provided in any of the embodiments shown.

Typically the outer shell of the column is constructed of a Stainless Steel material. It is anticipated that other materials which provide high strength and non-corrosive properties may be used for clean room applications.

Directional terms such as "front" "back" "in", "out" and the like are applicable to the embodiments shown and described in conjunction with the drawings. These terms are merely for the purpose of description and do not necessarily apply to the position in which the reinforced column of the present invention may be used.

While these particular embodiments of an improved reinforced column have been shown and described, it is to be understood that the invention is not limited thereto and protection is sought to the broadest extent that the prior art allows.

What is claimed is:

1. A reinforced column for a lifting apparatus including:

a) an elongated outer shell member, said elongated outer shell member having a rectilinear cross-section, one side of said outer shell having an elongated aperture therethrough, said elongated aperture having a predetermined length for allowing access to an interior portion of said column;

b) a pair of elongated guide rails, each of said elongated guide rails being positioned adjacent said elongated aperture, such that a major axis of said elongated guide rails is in substantially parallel alignment with a major axis of said elongated aperture;

c) a reinforcing means being simultaneously attached to selected surfaces of each elongated guide rail and a plurality of U-shaped support members, said U-shaped support members being spaced at predetermined intervals along the length of said elongated outer shell, said reinforcing means including an elongated inner shell member having a substantially U-shaped cross section for allowing a carriage member of said lifting apparatus to travel therein while said carriage member is guided by said elongated guide rails, an open side of said elongated inner shell member being aligned with said elongated aperture of said outer shell member, and wherein all walls of said elongated inner shell are held in a predetermined spaced relationship with interior walls of said elongated outer shell member by said plurality of U-shaped support members.

2. A reinforced column for a lifting apparatus including:

a) an elongated outer shell member, said elongated outer shell member having a rectilinear cross-section, one side of said outer shell having an elongated aperture therethrough, said elongated aperture having a predetermined length for allowing access to an interior portion of said column;

b) a pair of elongated guide rails, each of said elongated guide rails being positioned adjacent said elongated aperture, such that a major axis of said elongated guide rails is in substantially parallel alignment with a major axis of said elongated aperture;

c) a reinforcing means being simultaneously attached to selected surfaces of each elongated guide rail, said reinforcing means including an elongated inner shell member having a substantially U-shaped cross section, for allowing a carriage member of said lifting apparatus to travel interior thereof while said carriage member is guided by said elongated guide rails, an open side of said elongated inner shell member being aligned with said elongated aperture of said outer shell member, and wherein all walls of said elongated inner shell are held in a predetermined spaced relationship with interior walls of said elongated outer shell member by a plurality of attachment legs.

3. A reinforced column as recited in claim 2 wherein each of said attachment legs is arrayed for attaching a corner of said elongated inner shell member to a corresponding interior corner of said elongated outer shell member.

4. A reinforced column as recited in claim 2 wherein said elongated inner shell member includes a plurality of rectilinear apertures in one of its walls for allowing engagement of a mating safety device carried on said carriage member.

5. A reinforced column for a lifting apparatus including:

a) an elongated outer shell member, said elongated outer shell member having a rectilinear cross-section, one side of said outer shell having an elongated aperture therethrough, said elongated aperture having a predetermined length for allowing access to an interior portion of said column;

b) a pair of elongated guide rails, each of said elongated guide rails being positioned adjacent said elongated aperture, such that a major axis of said elongated guide rails is in substantially parallel alignment with a major axis of said elongated aperture;

c) a reinforcing means includes an elongated inner shell member having a substantially U-shaped cross section, an open side of said elongated inner shell member being aligned with said elongated aperture of said outer shell member, said elongated inner shell member being held in a predetermined spaced relationship with interior walls of said elongated outer shell member by an elongated channel member, said elongated channel member having its web portion abutting and attached to a web portion of said inner shell for forming a multi layered web portion and said reinforcing means is simultaneously attached to selected surfaces of each elongated guide rail.

6. A reinforced column as recited in claim 5 wherein said elongated inner shell member includes a plurality of rectilinear apertures in one of its walls for allowing engagement of a mating safety device carried on said carriage member.

* * * * *